US006629500B1

(12) United States Patent
Hansen

(10) Patent No.: US 6,629,500 B1
(45) Date of Patent: Oct. 7, 2003

(54) OPEN-COURSE COASTER WITH TWO VERTICAL END SEGMENTS

(76) Inventor: R. Trent Hansen, P.O. Box 1425, Bountiful, UT (US) 84011

( * ) Notice: Subject to any disclaimer, the term of this patent is extended or adjusted under 35 U.S.C. 154(b) by 0 days.

(21) Appl. No.: 09/441,429

(22) Filed: Jun. 23, 2000

Related U.S. Application Data

(60) Provisional application No. 60/108,823, filed on Nov. 17, 1998.

(51) Int. Cl.[7] ..... A63G 7/00
(52) U.S. Cl. ..... 104/53; 104/56; 104/69
(58) Field of Search ..... 104/53, 55, 56, 104/57, 63, 64, 66, 69, 72

(56) References Cited

U.S. PATENT DOCUMENTS 812,996 A * 2/1906 Hill ..... 104/53
1,084,390 A * 1/1914 Bosworth ..... 104/53
4,165,695 A * 8/1979 Schwarzkopf ..... 104/55
4,724,771 A * 2/1988 Yamada ..... 104/56
5,218,910 A * 6/1993 Mesmer et al. ..... 104/63
5,791,254 A * 8/1998 Mares et al. ..... 104/53

* cited by examiner

*Primary Examiner*—Mark T. Le
(74) *Attorney, Agent, or Firm*—Thompson E. Fehr

(57) ABSTRACT

A coaster having a first vertical segment connected to a parabolic segment that is connected to a second vertical segment. The carrier is raised up the first vertical segment by any means that is well known in the art. The carrier descends under the force of gravity and may either oscillate or be braked. Optionally, the track rolls about its longitudinal axis during the first vertical segment. The seats in the carrier are preferably in a tilted position so that when the carrier is vertical with the seats facing downward, the participants actually tilt forward past vertical.

8 Claims, 3 Drawing Sheets

OPEN-COURSE COASTER WITH TWO VERTICAL END SEGMENTS

CROSS-REFERENCE TO RELATED APPLICATION

This is a continuation of a copending U.S. provisional application No. 60/108,823, filed on Nov. 17, 1998.

BACKGROUND OF THE INVENTION

1. Field of the Invention

This invention relates to amusement rides and more particularly to coaster-type amusement rides.

2. Description of the Related Art

U.S. Pat. No. 4,724,771 discloses an amusement ride where a single carrier is elevated and then descends a single vertical portion of a track.

U.S. Pat. No. 5,218,910 includes prone seating for a passenger.

The present inventor is, however, unaware of any amusement ride where multiple coupled carriers are moved to the top of a vertical portion of track and then descend such vertical portion. Nor is the present inventor aware of an amusement ride where the carrier descends a vertical track, crosses along a parabolic portion of track, and then ascends another vertical portion of track.

SUMMARY OF THE INVENTION

The present invention has two vertical portions of track connected by a parabolic segment of track.

The carrier can be a single carrier or coupled carriers, either of which is elevated on one vertical section, allowed to descend, traverses the parabolic segment, ascends the other vertical section, descends again, and is either braked or allowed to oscillate.

The seats in the carrier are in a tilted position so that when the carrier is vertical, the participants actually tilt forward past vertical.

DESCRIPTION OF THE PREFERRED EMBODIMENT

Figure 1:
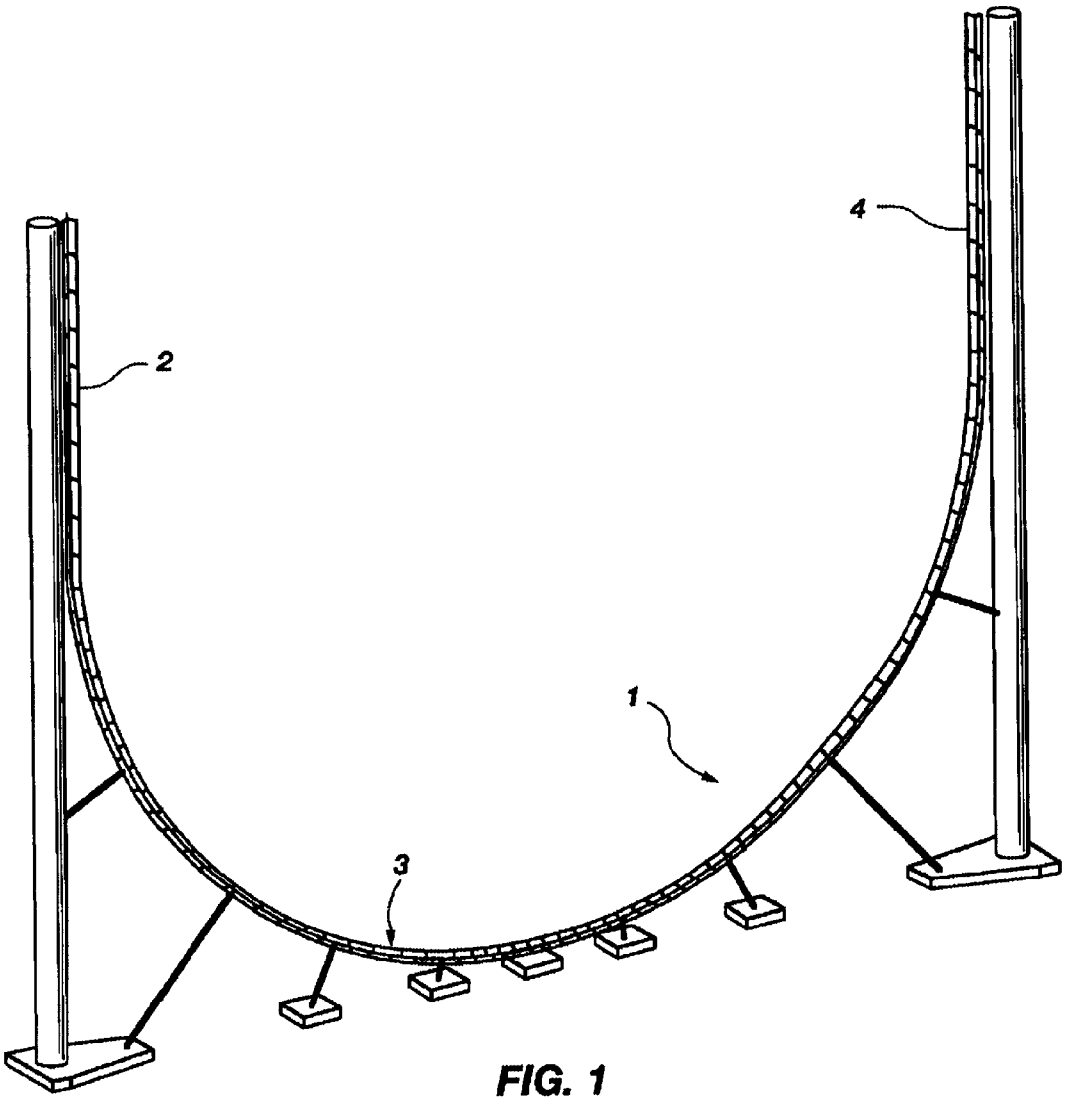
FIG. 1 illustrates the track for the Open-course Coaster with Two Vertical End Segments.
Figure 2:
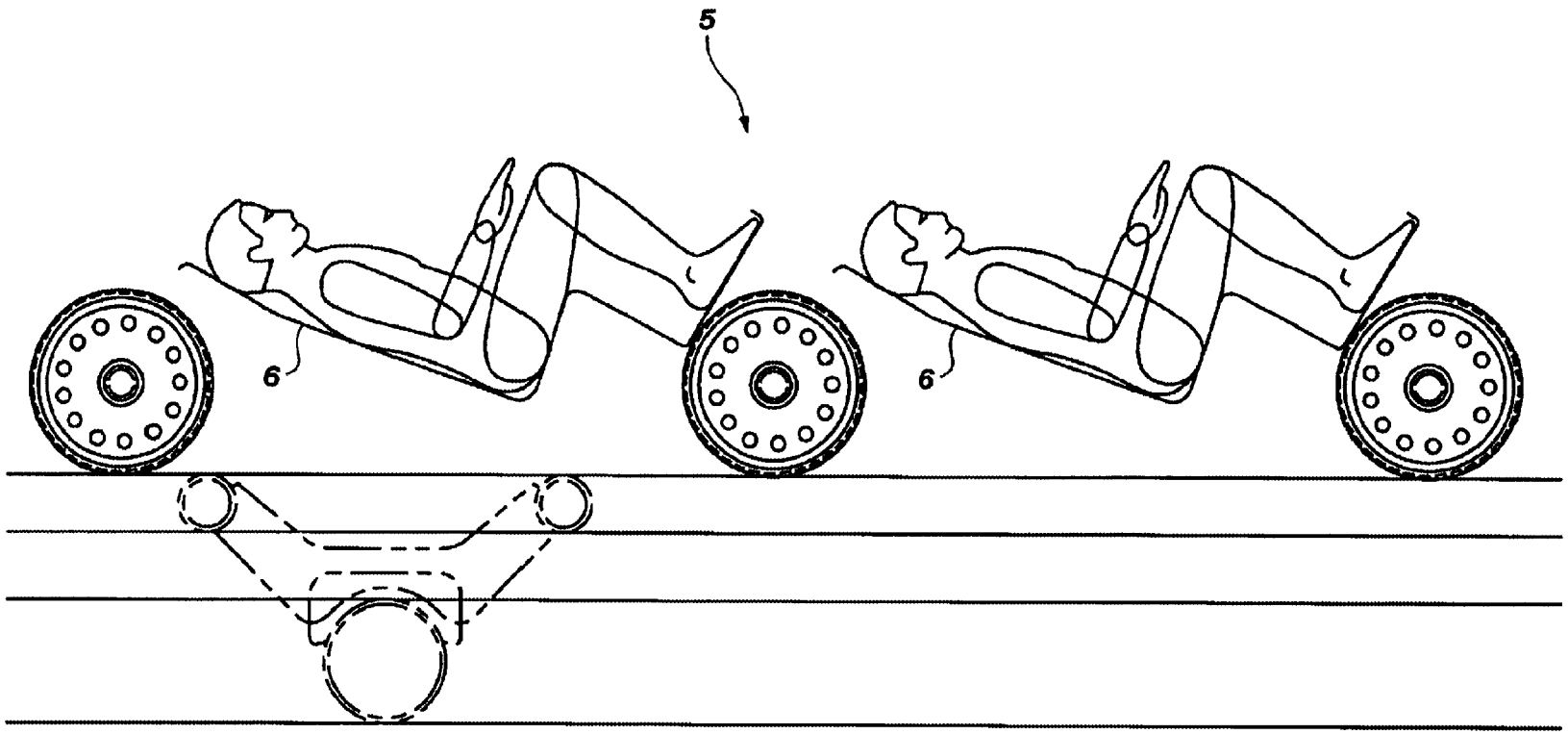
FIG. 2 depicts the orientation of the seats in the carrier of the Open-course Coaster with Two Vertical End Segments.
Figure 3:
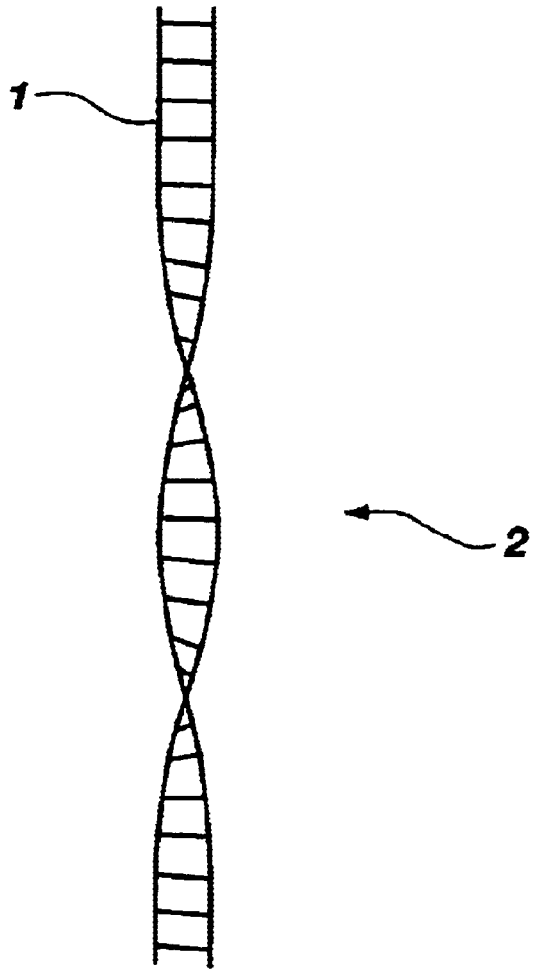
FIG. 3 illustrates the first vertical segment of track rolling about its longitudinal axis.

The present invention has a track 1 constructed in any manner that is well known in the art.

The uniqueness of the track 1 is the path which it follows. The track 1 consists a first vertical segment 2 connected to a parabolic segment 3 attached to a second vertical segment 4.

The carrier 5 can operate as an individual unit or be coupled to other carriers 5.

The carrier 5 or carriers 5 are raised along the track 1 up the first vertical segment 2 by any means that is well known in the art. The carrier 5 or carriers 5 then descend the first vertical segment 2 under the force of gravity, cross the parabolic segment 3, ascend the second vertical segment 4, descends the second vertical segment 4, and is then either braked by any means that is well known in the art or oscillates.

Optionally, the track 1 rolls about its longitudinal axis during the first vertical segment 2 so that the carrier 5 also rolls as it ascends and descends the first vertical segment 2.

The seats 6 in the carrier 5 are preferably in a tilted position so that when the carrier is vertical with the seats facing downward, the participants actually tilt forward (away from the track 1) past vertical.

I claim:

1. A coaster, which comprises:

a first vertical segment of track;

a parabolic segment of track connected to the lower end of said first segment of track;

a second vertical segment of track connected at its lower end to said parabolic segment of track at the end of said parabolic segment other than the end to which said first vertical segment of track is connected;

said track ended at the upper ends of said vertical segments;

a carrier that operates on said first vertical segment, said parabolic segment, and said second vertical segment of track; and a means for raising said carrier up said first vertical segment of track.

2. The coaster as recited in claim 1, wherein:

said first vertical segment of track rolls about its longitudinal axis so that said carrier would roll as it ascends and descends said first vertical segment.

3. The coaster as recited in claim 2, further comprising:

a brake for decelerating said carrier.

4. The coaster as recited in claim 3, wherein:

the seats in said carrier are tilted so that when said carrier is vertical with the seats facing downward, a participant in the carrier is tilted forward past vertical.

5. The coaster as recited in claim 2, wherein:

the seats in said carrier are tilted so that when said carrier is vertical with the seats facing downward, a participant in the carrier is tilted forward past vertical.

6. The coaster as recited in claim 1, further comprising:

a brake for decelerating said carrier.

7. The coaster as recited in claim 6, wherein:

the seats in said carrier are tilted so that when said carrier is vertical with the seats facing downward, a participant in the carrier is tilted forward past vertical.

8. The coaster as recited in claim 1, wherein:

the seats in said carrier are tilted so that when said carrier is vertical with the seats facing downward, a participant in the carrier is tilted forward past vertical.

* * * * *